US010128574B2

(12) United States Patent
Jansson

(10) Patent No.: US 10,128,574 B2
(45) Date of Patent: Nov. 13, 2018

(54) ANTENNA TUNING ASSEMBLY AND MOBILE COMMUNICATION APPARATUS USING SAME

(71) Applicant: Daniel Jansson, Shenzhen (CN)

(72) Inventor: Daniel Jansson, Shenzhen (CN)

(73) Assignee: AAC ACOUSTIC TECHNOLOGIES (SHENZHEN) CO., LTD, Shenzhen (CN)

( * ) Notice: Subject to any disclaimer, the term of this patent is extended or adjusted under 35 U.S.C. 154(b) by 171 days.

(21) Appl. No.: 14/950,747

(22) Filed: Nov. 24, 2015

(65) Prior Publication Data

US 2017/0149140 A1 May 25, 2017

(51) Int. Cl.

| | |
|---|---|
| ***H01Q 1/24*** | (2006.01) |
| ***H01Q 9/42*** | (2006.01) |
| ***H01Q 9/06*** | (2006.01) |
| ***H01Q 5/335*** | (2015.01) |

(52) U.S. Cl.

CPC ..... *H01Q 9/06* (2013.01); *H01Q 1/243* (2013.01); *H01Q 5/335* (2015.01); *H01Q 9/42* (2013.01)

(58) Field of Classification Search

CPC .. H01Q 1/2258; H01Q 1/2283; H01Q 1/2291; H01Q 1/24; H01Q 1/241; H01Q 1/242; H01Q 1/243; H01Q 1/50; H01Q 5/30; H01Q 5/307; H01Q 5/314; H01Q 5/335; H01Q 9/06; H01Q 9/42

See application file for complete search history.

(56) References Cited

U.S. PATENT DOCUMENTS

| | | | | |
|---|---|---|---|---|
| 6,937,196 | B2 * | 8/2005 | Korva | H01Q 1/243 343/700 MS |
| 7,039,437 | B2 * | 5/2006 | Kojola | H01Q 1/084 343/702 |
| 9,030,372 | B2 * | 5/2015 | Desclos | H01Q 1/243 29/600 |
| 2016/0164168 | A1 * | 6/2016 | Choi | H01Q 1/48 343/702 |

* cited by examiner

*Primary Examiner* — Tho G Phan
*Assistant Examiner* — Patrick Holecek
(74) *Attorney, Agent, or Firm* — Na Xu; IPro, PLLC

(57) ABSTRACT

An antenna tuning assembly is disclosed, including: a substrate; an input path on the substrate, for receiving control signals; a tuning network on the substrate, including an impedance circuit with a tunable impedance and at least one tuner connecting with the impedance circuit and the input path for generating an corresponding impedance in response to the control signals; an output path connecting with the tuning network on the substrate, for coupling to an external antenna according to the corresponding impedance.

13 Claims, 5 Drawing Sheets

ANTENNA TUNING ASSEMBLY AND MOBILE COMMUNICATION APPARATUS USING SAME

FIELD OF THE INVENTION

The disclosure described herein relates to a mobile communication apparatus, and more particularly to an antenna tuning assembly used in such a mobile communication apparatus.

DESCRIPTION OF RELATED ART

Nowadays, a mobile apparatus, such as a phone, having a metal shell is desired so as to obtain a fashion appearance. Compared with other shells made of other materials, metal shells not only have a fashion appearance, but also have many other advantages, such as a better stiffness, a greater strength, a thinner thickness, recyclable, a better heat radiation and so on. However, a metal shell will form a fatal electromagnetic shielding effect to an antenna located on a main PCB board therein, thus affecting the performance of the antenna. To improve the antenna performance, an antenna tuner is usually deposited the main PCB board to select a proper frequency for the antenna, but the antenna tuner may occupy the position for arranging other electronic components, and it may be difficult to control the distance between the antenna tuner and the antenna, thus affecting the antenna performances.

The present disclosure is accordingly provided to solve the problems mentioned above.

DETAILED DESCRIPTION OF THE EXEMPLARY EMBODIMENTS

The present invention will hereinafter be described in detail with reference to exemplary embodiments.

Figure 1:
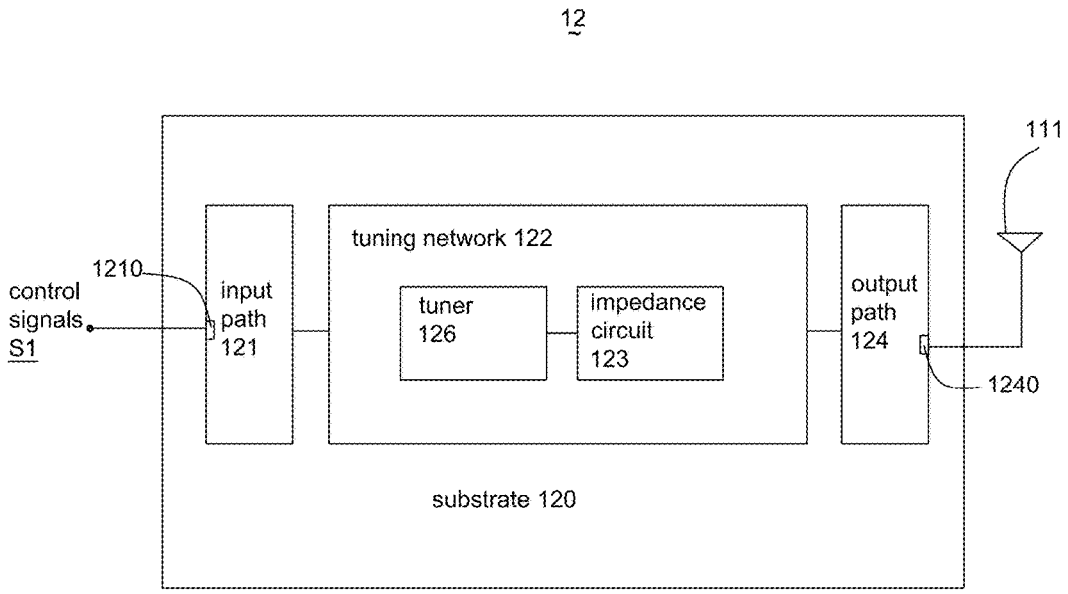
FIG. 1 is a first embodiment of an antenna tuning assembly of the present disclosure.

Referring to FIG. 1, an antenna tuning assembly 12 in accordance with an exemplary embodiment of the present invention is provided. The antenna tuning assembly 12 includes a substrate 120 on which a plurality of conductive paths are deposited. Especially, the conductive paths are configured by conductive ink printing or through a LDS (Laser Direct Structuring) process, in which case, a comparatively small size may be achieved. Additionally, the substrate 120 can be a single-sided or double-sided FPC (flexible printed circuit board), or made from a rigid PCB (printed circuit board). With a double-sided FPC structure, different conductive paths may be printed on different sides of the substrate 120, so as to decrease short-circuit faults. In alternative embodiments, the substrate 120 has a multi-layer structure of FPC with at least a part of the conductive paths sandwiched therebetween.

Those conductive paths include an input path 121 for receiving control signals S1 and an output path 124 for coupling to an external antenna 111. The antenna tuning assembly 12 further includes a tuning network 122 deposited on the substrate 120. The tuning network 122 includes an impedance circuit 123 with tunable impedances and at least one tuner 126 (for example a switch) connecting with the impedance circuit 123 and the input path 121 for generating a corresponding impedance in response to the control signals S1, and thus the antenna 111 can be tuned at a proper frequency according to the corresponding impedance.

As shown in FIG. 1, the output path 124 includes a first contact pad or a clip 1240 for connecting with the antenna 111. The input path 121 includes a second contact pad or clip 1210 for receiving the control signals S1 and a power signal S1. Optionally, the input path 121 receives the control signals S1 through a coaxial cable. Also, the connection between the output path 124 and the antenna 111 may be achieved by a coaxial connection.

Figure 2:
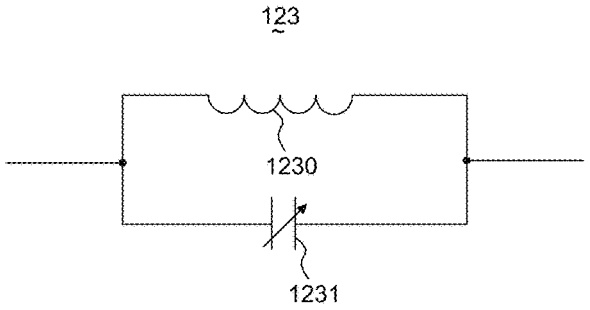
FIG. 2 is an illustration of an impedance circuit in the antenna tuning assembly in FIG. 1.

As shown in FIG. 2, the impedance circuit 123 includes a capacitor 1231 parallel connecting to an inductor 1230. Specifically, each pair of one capacitor 1231 and one inductor 1230 may form a basic unit of the impedance circuit 123, and the impedance circuit 123 may include a plurality of basic units. The tuner 126 may choose the number of the basic units to connect, so as to change the corresponding impedance to transfer to the output path 124.

Figure 3:
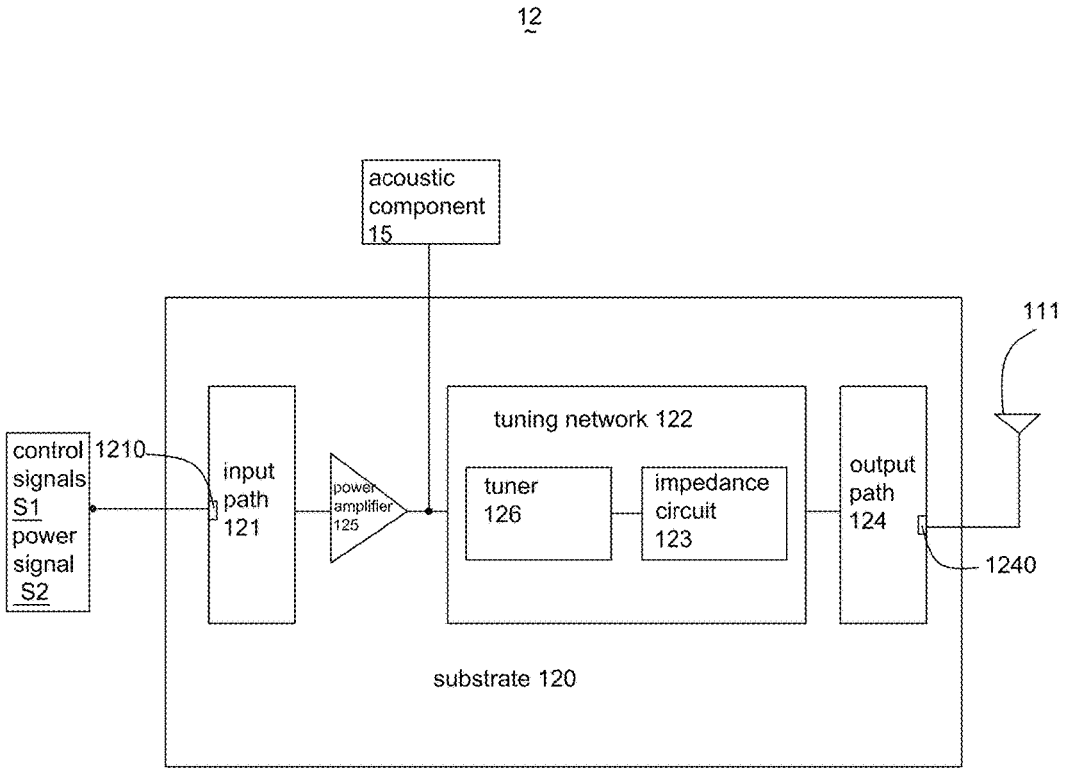
FIG. 3 is a second embodiment of an antenna tuning assembly of the present disclosure.

FIG. 3 illustrates a second embodiment of the antenna tuning assembly 12 in the disclosure. In this embodiment, the antenna tuning assembly 12 also includes the input path 121, the tuning network 122 and the output path 124, which are already described in the first embodiment. Further, the antenna tuning assembly 12 in this embodiment includes a power amplifier 125 connecting to the input path 121. The input path 121 is configured for receiving the control signal S1 as well as a power signal S2, and the power signal S2 is amplified by the power amplifier 125 for a better performance and a high efficiency. Additionally, when the antenna tuning assembly is applied in a mobile communication apparatus, the power signal S2 can be supplied to other electronic components, for example some acoustic components 15, i.e., a microphone or speaker, thus enhancing the acoustic performances.

Figure 4:
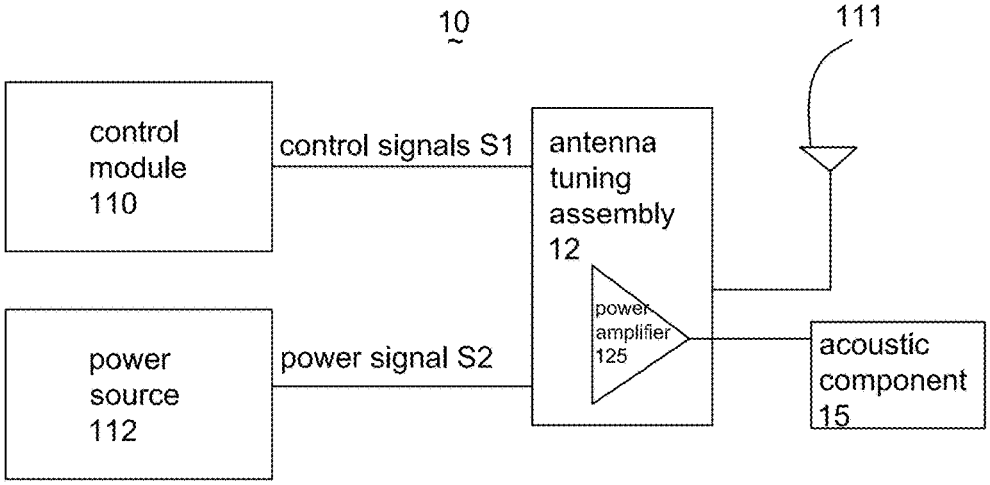
FIG. 4 is a simplified illustration of a mobile communication apparatus of the present disclosure.

FIG. 4 illustrates a mobile communication apparatus 10 in accordance with an exemplary embodiment of the present invention. The mobile communication apparatus 10 includes the above-mentioned antenna tuning assembly, a control module 110 for generating the control signals S1, and the antenna 111. Further, a power source 112 for generating the power signal S2 may also be included in the mobile communication apparatus 10 and provide power supply for other components in the mobile communication apparatus 10. Optionally, the above-mentioned power amplifier 125 may also be included in this embodiment, for amplifying the power signal S2 from the power source 112.

Figure 5:
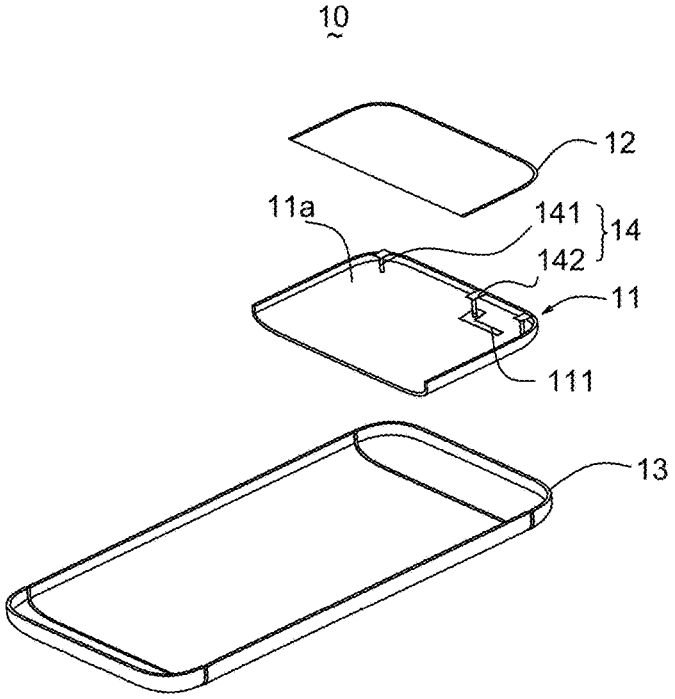
FIG. 5 is a first embodiment of the structure of the mobile communication apparatus in FIG. 4.

As shown in FIG. 5, the control module 110 and the antenna may be deposited on main board 11, and the mobile communication apparatus 10 includes a cover 13 for receiving both the main board 11 and the antenna tuning assembly 12. The above-mentioned power source 112 is positioned on the main board 11, for example a PCB, and the antenna tuning assembly 12 may be connected to the power source 112 through a ZIF/LIF connector. In this embodiment, the antenna tuning assembly 12 is stacked on the main board 11.

The cover 13 is especially a metallic cover. Specifically, the main board 11 has a first surface 11*a* apart from the cover 13, and the antenna tuning assembly 12 is stacked on the first surface 11*a*. The antenna 111 is printed on the first surface 11*a*, and a plurality of conducting feet 14 is mounted on the first surface 11*a*. Those conducting feet 14 respectively connects to the main board 11, especially to a feeding or grounding part of the antenna 111. The supporting feet 14 includes a supporting pillar 141 extending perpendicularly out away from the first surface 11*a* and a contacting plate 142 configured on an end of the supporting pillar 141. The antenna tuning assembly 12 is supported by the supporting feet 14, and connected to the main board 11 trough the contacting plate 142 and the supporting pillar 141.

Figure 6:
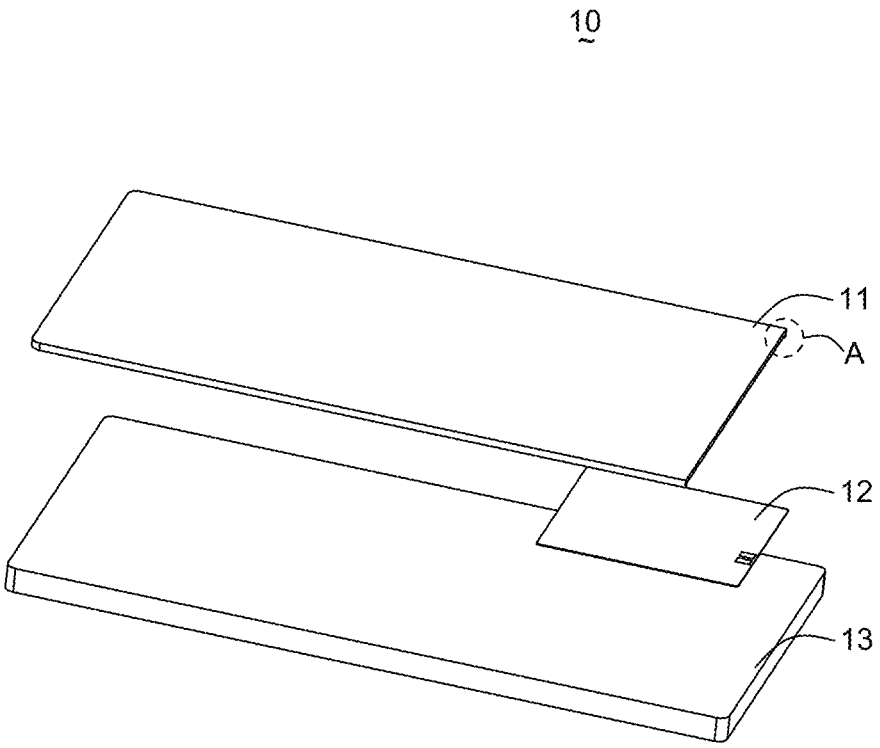
FIG. 6 is a second embodiment of the structure of the mobile communication apparatus in FIG. 4.
Figure 7:
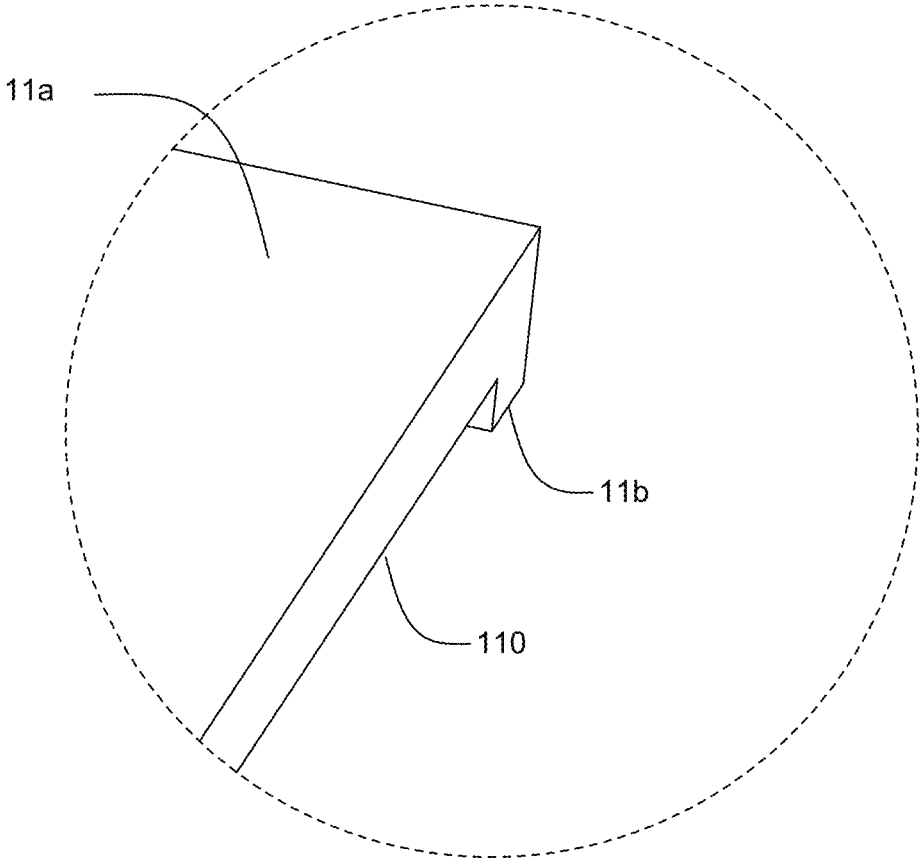
FIG. 7 is an enlarged view of Part A in FIG. 6.

Referring to FIGS. 6-7, a second embodiment of the mobile communication apparatus 10 is shown. In this embodiment, the mobile communication apparatus 10 also includes a cover 13 for receiving both the main board 11 and the antenna tuning assembly 12, while the main board 11 has a first surface 11*a* facing the cover 13 and a second surface 11*b* opposed to the first surface 11*a*. A slot 110 is defined on the first surface 11*a* for receiving the antenna tuning assembly 12.

In some other embodiments, the antenna tuning assembly 12 may be fixed by some other parts of the mobile communication apparatus 10, for example be fixed on the cover 13 through screws, snaps or by adhesion agents.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mobile communication apparatus, comprising:

an antenna tuning assembly comprising: a substrate; an input path deposited on the substrate; for receiving control signals, a tuning network deposited on the substrate, including an impedance circuit with a tunable impedance and at least one tuner connecting with the impedance circuit and the input path for generating a corresponding impedance in response to the control signals; an output path connecting with the tuning network and deposited on the substrate, for coupling to an external antenna according to the corresponding impedance; and a power amplifier connecting to the input path for amplifying a power signal;

a control module connected to the input path, for generating the control signals;

and the external antenna, coupling with the output path;

wherein the mobile communication apparatus comprises a main board on which the antenna and the control module are deposited, and the antenna tuning assembly is stacked on the main board, the antenna tuning assembly is formed into an integrally piece and independent from the main board;

the mobile communication apparatus comprises a cover and the antenna tuning assembly is assembled on the cover; and the main board has a first surface on which the antenna tuning assembly is stacked, and a recess concave away from the antenna tuning assembly is defined on the first surface for receiving the antenna tuning assembly, with the antenna tuning assembly and the first surface spaced apart.

2. The mobile communication apparatus as described in claim 1, wherein the mobile communication apparatus comprises a power source for generating a power signal, which connects to the antenna tuning assembly, the control module and the external antenna.

3. The mobile communication apparatus as described in claim 1, wherein, the mobile communication apparatus comprises an acoustic component connecting to the power amplifier and driven by the power signal.

4. The mobile communication apparatus as described in claim 1, wherein, the main board is sandwiched between the antenna tuning assembly and the cover.

5. The mobile communication apparatus as described in claim 1, wherein, the antenna tuning assembly is sandwiched between the main board and the cover.

6. The antenna tuning assembly as described in claim 1, wherein the impedance circuit comprises a capacitor parallel connecting to an inductor.

7. The antenna tuning assembly as described in claim 1, wherein the output path comprising a contact pad or clip for connecting with the antenna.

8. The antenna tuning assembly as described in claim 1, wherein the substrate has a multi-layer structure of a flexible printed circuit board with at least a part of the input path and/or output path sandwiched therein.

9. The antenna tuning assembly as described in claim 1, wherein the input path is deposited on the substrate by conductive ink printing or through a LDS process.

10. The antenna tuning assembly as described in claim 1, wherein the output path is deposited on the substrate by conductive ink printing or through a LDS process.

11. The antenna tuning assembly as described in claim 1, wherein the input path comprises a contact pad or clip for receiving the control signals and the power signal.

12. The antenna tuning assembly as described in claim 1, wherein the external antenna is printed on the first surface, and a plurality of conducting feet is mounted on the first surface and connect to the external antenna respectively.

13. The antenna tuning assembly as described in claim 12, wherein the supporting feet includes a supporting pillar extending perpendicularly out away from the first surface and a contacting plate configured on an end of the supporting pillar, and the antenna tuning assembly is supported by the supporting feet, and connected to the main board through the contacting plate and the supporting pillar.

* * * * *